US007800286B2

(12) United States Patent
Perreault

(10) Patent No.: US 7,800,286 B2
(45) Date of Patent: Sep. 21, 2010

(54) ALPHA FUSION ELECTRICAL ENERGY VALVE

(76) Inventor: Bruce Alan Perreault, 1072 NH Route 118, Dorchester, NH (US) 03266-6409

( * ) Notice: Subject to any disclaimer, the term of this patent is extended or adjusted under 35 U.S.C. 154(b) by 758 days.

(21) Appl. No.: 11/744,769

(22) Filed: May 4, 2007

(65) Prior Publication Data

US 2008/0272680 A1 Nov. 6, 2008

(51) Int. Cl.
*H01J 17/32* (2006.01)
*G21H 1/00* (2006.01)

(52) U.S. Cl. ..... 313/54; 313/574; 313/310; 310/305

(58) Field of Classification Search ..... None
See application file for complete search history.

(56) References Cited

U.S. PATENT DOCUMENTS 2,926,268 A * 2/1960 Ralph ..... 313/54
2,958,798 A * 11/1960 Anton ..... 313/54

* cited by examiner

*Primary Examiner*—Ashok Patel

(57) ABSTRACT

Alpha particles are directed and focused onto a delta-ray cathode target, where an alpha fusion reaction is generated. Delta radiation or high-energy secondary electrons are generated from the said alpha reaction. The cathode also becomes thermally active generating thermionic electrons. The electrons flow in the direction of an anode that absorbs their energy, generating electrical current in one direction, known in the electrical field as direct current.

1 Claim, 2 Drawing Sheets

ALPHA FUSION ELECTRICAL ENERGY VALVE

FIELD OF INVENTION

Figure 1:
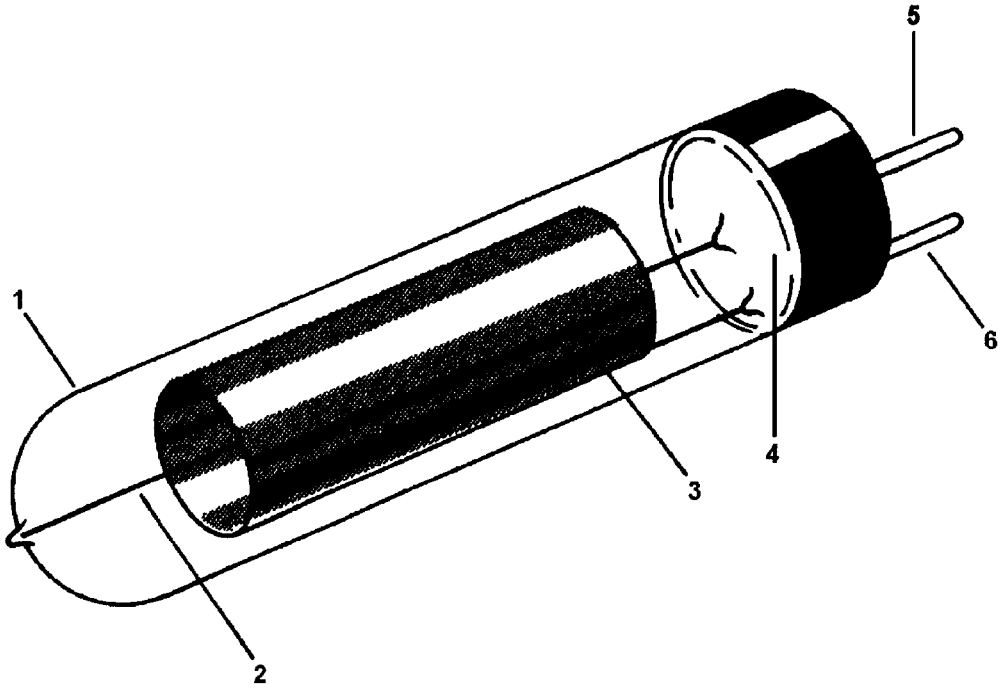

This invention in general is related to atomic cells and nuclear batteries.

BACKGROUND OF THE INVENTION

Prior art atomic cells and nuclear batteries are limited because they generate low currents. Another drawback is that expensive radioisotopes are obtained from a nuclear reactor in their construction.

The present invention overcomes the aforementioned limitations by utilizing an alpha fusion reaction and radon emissive material. The alpha fusion reaction economically generates high power densities. The present invention provides a unique concept that offers improved performance over prior art direct nuclear conversion systems. The new and novel invention that will be described utilizes an alpha fusion reaction that generates practical and useful electrical current.

Devices that convert ionizing energy to electrical current have been used in prior art, but with poor results.

Atomic cells generate electric currents by utilizing charged particles that are ejected from radioactive substances. The Direct Conversion of Energy was published by the GPO in 1964. On pages 28-29 William R. Corliss discusses the direct use of charged particles that are ejected from radioisotopes. He states that high velocity beta particles ejected from ${}_{38}Sr^{90}$ generates a flow of electrical current. The negative charges on the particles become neutralized when they strike a metallic cylinder. The neutralized particles find their way back to the ${}_{38}Sr^{90}$ becoming again ionized. This cycle repeats itself so long as the ${}_{38}Sr^{90}$ remains radioactive.

U.S. Pat. No. 2,926,268 describes a self-powered electron tube that generates secondary electrons when high-energy radiations, primarily from beta particles strike a semi-conductive material.

The power generated by the above two sited examples generate high-voltage but produce extremely low amperage. There are numerous patents issued world wide relating to the direct conversion of charged atomic particles that generates electrical current but all produce low power densities in the millionth of a watt range.

Despite the prior art that exists in this technology, it is believed that there has not previously existed a small, compact electrical device capable of generating a high power output. It is the object of this invention to provide a method embodying a new and novel device to furnish an efficient and economical source of electrical power. The present invention resolves limitations of the prior art.

The primary object of the present invention is to provide a method that directly utilizes charged particles to produce electrical current, and a new and novel device for utilizing an alpha-fusion nuclear reaction to generate the charged particles.

SUMMARY OF THE INVENTION

The present invention relates to a method that generates electrons which can be converted to electrical energy and more particularly, to electrical power generation through the fusion of alpha particles with carefully chosen target elements, compounds, or alloys.

The present invention may serve as a source of electrical current that is consistent a full 24 hours per day which is safe and non-polluting.

The present invention is an original approach to the generation of electrical current, which relies upon an alpha fusion reaction. It is the main object of the present invention to provide a method and device for generating electrical energy that result from the reaction of alpha particles with specific materials.

It is generally accepted that helium gas will not form compounds in any chemical combination. This gas generally is believed to be chemically inert. What is not readily realized is that helium will react with a few substances when sufficiently excited. It is a well-established fact; helium is a gas that accompanies all radioactive minerals in an excited state. The name for a high-energy helium atom is called an "alpha particle" in the scientific literature. Until now, its role in nuclear transformations has not been fully realized. The quantity of energy that is released under certain conditions is considerable. This conclusion was reached by the early scientific community because the small amount of ejected particles coming from radioactive matter possesses an enormous velocity, carrying with them enormous amounts of energy. The alpha particle reaction is a liberator of an enormous reserve of stored atomic energy.

An example of an alpha fusion reaction can be demonstrated by depositing radon gas onto a beryllium wire. The resulting reaction was used to generate neutrons in the early days of atomic energy to initiate a fission reaction using fissile ${}_{92}U^{235}$. The reaction is expressed in the following equations;

$${}_{4}Be^{9}+{}_{2}He^{4}\text{ (high energy alpha particle)}\rightarrow{}_{6}C^{12}\ {}_{0}n^{1}\text{ (fast neutron)}$$

$${}_{4}Be^{9}+{}_{0}n^{1}\text{ (fast neutron)}\rightarrow{}_{4}Be^{8}+2{}_{0}n^{1}$$

$${}_{4}Be^{8}\rightarrow 2{}_{2}He^{4}\text{ (high energy alpha particles)}$$

In these equations, beryllium reacts with an excited alpha particle generating a fusion reaction with neutrons as its by-product. Enrico Fermi describes this reaction in his U.S. Pat. No. 2,206,634 Process for the Production of Radioactive Substances. The atoms are not fragmented in the above expressed reaction as is the case when a fission reaction is created. A fusion reaction can produce non-radioactive stable by-products, along with a supply of useful electrons, unlike a fission reaction that creates a number of radioactive deadly waste products.

In the present invention a germanium plated, negatively charged corona cathode wire or thin rod, used in conjunction with a palladium or graphite positively charged anode concentric cylinder, can be utilized in its construction. Other materials can be used and this will not depart from the spirit of the present invention. Germanium used as a target material is a good choice because ${}_{32}Ge^{72}$ will react with alpha particles generating stable ${}_{34}Se^{77}$ and high-energy electrons within the process, in which:

$${}_{32}Ge^{72}+{}_{2}He^{4}\text{ (high energy alpha)}\rightarrow{}_{34}Se^{75}+{}_{0}n^{1}$$

$${}_{34}Se^{75}\text{ EC }(e^{-}\text{ capture})\rightarrow{}_{33}As^{75}\text{ stable}$$

$${}_{32}Ge^{76}+{}_{0}n^{1}\rightarrow{}_{32}Ge^{77}$$

$${}_{32}Ge^{77}\rightarrow{}_{33}As^{77}\text{+beta (high energy electron)}$$

$${}_{33}As^{77}\rightarrow{}_{34}Se^{77}\text{ stable+beta (high-energy electron)}$$

It takes at least 6.06 MeV of energy to generate a ${}_{32}Ge^{72}$ alpha fusion reaction. Alpha particles are ejected from $Po^{212}$ with the energy release of 8.78 MeV, $Po^{214}$ with the energy release of 7.68 MeV, and $Po^{216}$ with the energy release of 6.78 MeV; these elements can be used to generate $_{32}Ge^{72}$ alpha fusion reactions. Therefore, $Po^{218}$ with the energy release of 6.00 MeV cannot be used to generate a $_{32}Ge^{72}$ alpha fusion reaction. $Po^{210}$ with the energy release of 5.30 MeV cannot be used to generate a $_{32}Ge^{72}$ alpha fusion reaction. These two later radioisotopes cannot be used to generate a $_{32}Ge^{72}$ alpha fusion reaction because their energy levels are below the threshold of 6.06 MeV that is required to initiate the reaction. $Rn^{220}$ with the energy release of 6.29 MeV of energy and can also be used to generate a $_{32}Ge^{72}$ alpha fusion reaction. It is a good choice because it is the daughter product of $Th^{228}$, which is abundant on the earth. It is a daughter product of $Th^{232}$, which is said to be more abundant than lead. The sited equations are a few theoretical examples from whence the present invention obtains its energy. Numerous reactions are possible. Other radioisotopes, than what is sited herein, might also be used and this will not depart from the spirit of the present invention.

A number of electron emitting and electron collecting materials can be used and this will not depart from the spirit of the invention. Other cathode and anode geometries may also be used and this will not depart from the spirit of the invention. However, the target material or cathode must be a delta-ray emitter. In the scope of the present invention, "a delta ray is characterized by very fast electrons produced in quantity by alpha particles. Collectively, these electrons are defined as delta radiation when they have sufficient energy to ionize further atoms through subsequent interactions on their own."

In the present invention, a new and novel improvement in the art of the direct conversion of nuclear energy is made apparent. The present invention generates electrons that are the result of atomic reactions that are efficiently converted to electrical current, which is novel in the field. Converted atomic energy within the scope of the present invention is directly available for driving motors, lighting, production of heat, and can be used in electrochemistry, etc. . . .

It is a further object of this invention to provide a device for generating electrical current that results from a self-generating electron source that is simple in construction and compact.

Thus, in accordance with the present invention there is provided a method of generating delta rays, or secondary electrons through the prescribed fusion reaction. The present invention provides a method and device that gives improved performance over prior art that utilizes the direct conversion of atomic reactions to obtain electrical power.

Figure 2:
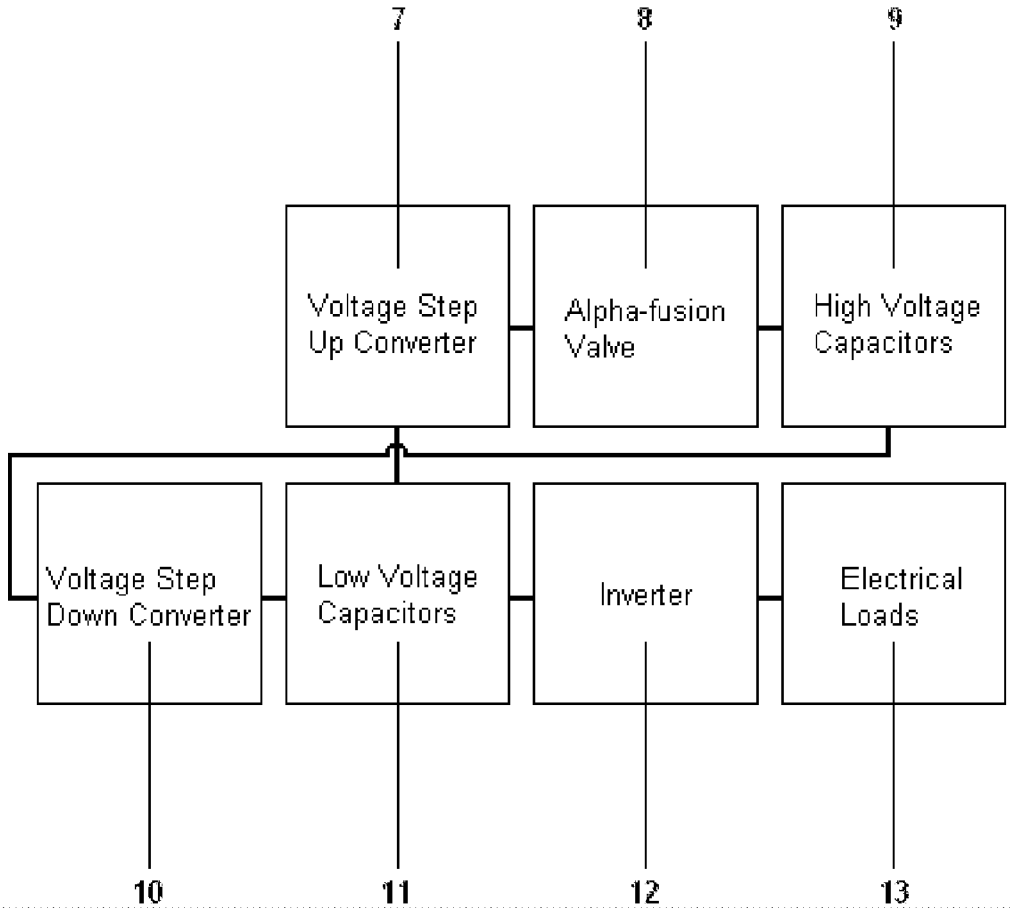

Other objects and advantages of the present invention will become apparent from the following description of the preferred embodiment of the present invention, with references to the attached drawings, in which:

FIG. 1 is an embodiment in its most basic form illustrating the alpha fusion valve which is unique in the present art of generating electrical power; and FIG. 2 is a block diagram that illustrates the invention in a useful embodiment. The diagram shows an electronic high voltage, low amperage, high frequency power supply. A means to rectify the output of the high frequency power supply is provided. The output of this power supply is coupled to the invention which activates the alpha fusion valve. The polarized current coming from the output of alpha fusion reaction vessel charges a storage capacitor. The stored charge is then connected to a voltage step-down circuit.

DETAILED DESCRIPTION OF THE PREFERRED EMBODIMENTS

The method to generate electrical energy includes a cathode which reacts with alpha particles generating electrically charged particles.

The device that will be described includes an electron generating cathode and alpha source that allows for a practical and compact power supply. Atomic reactions are converted to electrical energy with extreme efficiency within the scope of the present invention.

Furthermore, it will be understood that the generated electrical current can be directly converted into a useful voltage and amperage.

The conversion of the electrons that are emitted from said cathode generates useful electrical current that will be made apparent and that the alpha fusion valve is unique in generating electrical power. It will be made apparent in the following descriptions;

Referring now to FIG. 1 of the drawings, the said invention consists of a vessel 1 that is made out of an electrically insulating airtight material, such as glass, ceramic, plastic or the like.

It is preferred that a natural alpha source be used but an artificial alpha source might also be used and this will not depart from the spirit of the present invention.

Vessel 1 includes a corona wire 2, made out of a delta-ray emissive element, compound, or alloy, such as germanium, silicon, or lead-sulfide, etc. . . . delta-ray emissive substances emit delta-ray electrons when bombarded with alpha particles.

The vessel 1 contains a high work function electron-collecting cylinder 3, preferably made out of palladium because this metal can absorb a large volume of gas. After a period of time, the alpha particles lose their charge, become helium gas, build up, and the present invention eventually becomes electrically blocked. This is because helium gas is electrically non-conductive. A high work function material that has the ability to absorb gas will delay this process. Other alternative electrical collector materials, such as activated carbon, which has the ability to absorb large volumes of gas, may be used and this will not depart from the spirit of the invention.

Radon gas emissive radioactive material 4 is placed at the base inside vessel 1. The radioactive material 4 can be placed in a number of locations within vessel 1 and still not depart from the spirit of the invention. The electron emitter 2 can take the form of a wire, rod, cylinder, disc, plate, etc. . . . The electron collector 3 can also take the form of a wire, rod, cylinder, disc, plate, etc. . . . I do not stake my claim on the form or geometry of the electron emitter or electron collector. I stake my claim on the method used to generate electrical power using an alpha fusion reaction.

In the instant invention a negative charge of one-thousand volts or higher is applied to pin 5, which is electrically connected to corona wire 2. Respectively, a positive charge is applied to pin 6 which is electrically connected to a high work function electron collection cylinder 3. This has the effect of attracting and concentrating radon gas onto the corona wire 2 which becomes an abundant supply of alpha reactive particles. A lower voltage may also be applied across pin 5 and pin 6. The applied voltage will depend on the parameters of the wattage design of the present invention, which are too numerous to mention.

Electrically conductive pin 5 and pin 6 exit through an airtight seal at the bottom of vessel 1, not shown. There are a number of sealants that are available in the field. The inner cavity of vessel 1 is evacuated of air at a low pressure of about 1/10th of an atmosphere. The amount of air that is evacuated is not critical but care must be taken not to obtain too low of a vacuum because this can result in the generation of undesirable x-ray emission. There are a number of high voltage sources that can be used to apply the required activating potential through pin 5 and pin 6 and this will not depart from the spirit of the present invention. I stake my claim to my new and novel method that directly generates electrical power which results from the alpha fusion process and I do not stake my claim to the activating external voltage source thereof.

The speed in which the present invention will build up power depends on the potential difference that is applied to it and type of radon gas that it contains. The quantity of the alpha particle source determines the amount of amperage that is generated. The target material 2 is also a determining factor of how much current will be generated. When the target material 2 temperature rises, a greater number of electrons are emitted from its surface. The heated cathode 2 increases the odds of alpha particles hitting head on with its atoms, thus, producing a greater number of alpha fusion reactions, which further increases the surface heat boiling off additional thermally generated electrons. The surface area of the cathode 2 and anode 3 is also a determining factor of how much electrical current will be obtained.

The present invention generates a high voltage direct current. The present invention also generates a greater amperage per given density from what has been obtained from any previously known method or device in the prior art.

The instant invention described can be slightly modified to convert high voltage, high frequency, and radio frequency currents into a direct current. This feature is accomplished by adding an electrically conductive substance such as mercury, not shown, into the electrically non-conducting vessel 1. Any number of electrically conductive substances that will form a vapor or gas when heated can be used and this will not depart from the spirit of the invention. Said modification can also be utilized without the use of the radioactive substance 4, if the input source has enough energy to excite the vapor or gas into its electrically conductive state. The present modification of the primary invention is more efficient than the prior art in converting alternating or oscillating currents because there is less electrical resistance in the conversion process. Therefore, energy can be more efficiently received and converted into a direct current.

Referring now to FIG. 2 of the drawings;

The present invention is named alpha fusion valve 8 in the block diagram that follows:

The block diagram shown illustrates an example of how an alpha fusion valve 8 can be utilized in a practical application. Many differing types of systems are made possible using the present invention and will not depart from the spirit of the invention.

The alpha fusion valve 8 must be energized by an external potential difference to function if it is initially inactive or is allowed to become inactive after it has been producing power, not shown. This can be accomplished by applying a high voltage charge obtained from an electronic power supply 7. The reactions will build up within the alpha fusion valve 8 to the point where the surface of its internal electron emitter is totally bathed with radon gas. The alpha fusion valve 8 has to be primed with a potential difference to begin generating electrical power. The alpha fusion valve 8 produces a high voltage direct current. The output of the alpha fusion valve 8 can be used to charge a high voltage capacitance 9. The high voltage is then lowered to twelve volts through a step-down converter 10. The twelve volts then charges a low voltage capacitance 11 which can be a set of parallel-connected twelve-volt storage batteries. A set of parallel-connected high farad capacitors could also be used. The stored energy in capacitance 11 can be used to provide power to electrical loads that require a twelve-volt direct current or it can provide a twelve-volt power supply to an inverter 12. The output of the inverter 12 can be designed by methods known in the art to provide a voltage and frequency that is required by specific electrical loads 13. It is preferable that an electronic voltage source be used to keep the alpha fusion valve 8 in a constant energized state, which can be alternating or non-alternating. Numerous electronic circuit designs may be used to supply the potential difference required to energize the alpha fusion valve 8. Such electronic circuits are known in the field and are not what I stake my claim to. Alternatively, a strong enough source of alpha, beta, gamma radiation or a combination thereof may also be used to energize the alpha fusion valve 8.

A simple earth ground and antenna raised to a suitable height can be used to take advantage of the potential difference that exists between the planet and its atmosphere, although this is not always practical. Charging capacitance 9 with this method is unpredictable and slow. Any suitable circuit may be used to supply the required potential difference to energize the alpha-fusion valve 8 and this will not depart from the spirit of the invention.

Having thus described the invention, what is claimed is:

1. An electrical energy generator for generating electric energy comprising:

a vessel constructed of an airtight, electrically insulating material, said vessel including a base and an inner cylindrical wall defining a cavity, the vessel further including:

(a) a negatively charged corona wire made of a low work function delta-ray emissive material which functions as an electron emitter, and including germanium, silicon or lead-sulfide for emitting delta ray electrons when bombarded with high energy alpha particles;

(b) a high work function electron collector having a cylindrical shape and made of palladium (Pd) or an activated carbon and located coaxially inside the vessel;

(c) a radon gas that decays to a radio isotope having an energy level greater than 6.06 MeV, which expands and thereby fills the cavity of the vessel; and (d) first and second electrically conductive pins being attached to the base through airtight seal and facing away from the cavity, the first pin being electrically connected to the corona wire and the second pin being electrically connected to the high work function electron collector, wherein the corona wire is initially charged through an external negative charge applied at the first pin, and the high work function electron collector is initially charged through an external positive charge applied at the second pin, and wherein, after charging of the corona wire and the high work function electron collector, the first and second pins act as cathode and anode respectively of the electrical energy generator.

* * * * *